US012765599B2

(12) United States Patent
Lu et al.

(10) Patent No.: US 12,765,599 B2
(45) Date of Patent: Oct. 20, 2026

(54) AEROSOL-GENERATING DEVICE AND HEATING ASSEMBLY THEREOF

(71) Applicant: Hainan Moore Brothers Technology Co., Ltd., Hainan (CN)

(72) Inventors: Xiangan Lu, Hainan (CN); Hao Wen, Hainan (CN); Zhenlong Jiang, Hainan (CN)

(73) Assignee: Hainan Moore Brothers Technology Co., Ltd., Hainan (CN)

( * ) Notice: Subject to any disclaimer, the term of this patent is extended or adjusted under 35 U.S.C. 154(b) by 567 days.

(21) Appl. No.: 18/360,759

(22) Filed: Jul. 27, 2023

(65) Prior Publication Data

US 2024/0041113 A1 Feb. 8, 2024

(30) Foreign Application Priority Data

Aug. 8, 2022 (CN) ..... 202210946055.6

(51) Int. Cl.
*A24F 40/46* (2020.01)
*A24F 40/20* (2020.01)
*A24F 40/70* (2020.01)

(52) U.S. Cl.
CPC ..... *A24F 40/46* (2020.01); *A24F 40/20* (2020.01); *A24F 40/70* (2020.01)

(58) Field of Classification Search
None
See application file for complete search history.

(56) References Cited

U.S. PATENT DOCUMENTS

2020/0046028 A1 2/2020 Oh et al.
2020/0359704 A1* 11/2020 Deng ..... A24F 40/70
2021/0045447 A1 2/2021 Oh

FOREIGN PATENT DOCUMENTS

| | | | |
|---|---|---|---|
| CN | 207948900 | U | 10/2018 |
| CN | 208875419 | U | 5/2019 |
| CN | 109846090 | A | 6/2019 |
| CN | 209031260 | U | 6/2019 |
| CN | 111011931 | A | 4/2020 |
| CN | 210809313 | U | 6/2020 |
| CN | 112493557 | A | 3/2021 |
| CN | 212911679 | U | 4/2021 |
| CN | 112971218 | A | 6/2021 |
| CN | 214483241 | U | 10/2021 |
| CN | 215347054 | U | 12/2021 |
| CN | 215775567 | U | 2/2022 |
| CN | 215775577 | U | 2/2022 |

(Continued)

OTHER PUBLICATIONS

Chinese Patent Office, Office Action in Chinese Patent Application No. 202210946055.6 (May 19, 2025).

(Continued)

*Primary Examiner* — Katherine A Will
(74) *Attorney, Agent, or Firm* — Leydig, Voit & Mayer, Ltd.

(57) ABSTRACT

A heating assembly, applicable to an aerosol-generating device, includes: a heating rod; a covering film covering part of the heating rod; and a fixing base fitted on the heating rod, a fitting hole being formed on the fixing base. The heating rod includes a functional part with the covering film and a fitting part without the covering film. The fitting part is accommodated in the fitting hole.

20 Claims, 5 Drawing Sheets

(56) References Cited

FOREIGN PATENT DOCUMENTS

| | | | |
|---|---|---|---|
| CN | 114304749 | A | 4/2022 |
| CN | 114587023 | A | 6/2022 |
| CN | 216651324 | U | 6/2022 |
| CN | 218605115 | U | 3/2023 |
| EP | 3626090 | A1 | 3/2020 |
| JP | 3217713 | U | 8/2018 |
| JP | 2020517073 | A | 6/2020 |
| JP | 2021517466 | A | 7/2021 |
| KR | 1020210031687 | A | 3/2021 |
| WO | 2018135888 | A1 | 7/2018 |
| WO | 2019199010 | A1 | 10/2019 |
| WO | 2021001910 | A1 | 1/2021 |
| WO | 2021004837 | A1 | 1/2021 |
| WO | 2021116354 | A1 | 6/2021 |
| WO | 2021139491 | A1 | 7/2021 |
| WO | 2021165327 | A1 | 8/2021 |
| WO | 2021228153 | A1 | 11/2021 |
| WO | 2021232250 | A1 | 11/2021 |
| WO | 2022062342 | A1 | 3/2022 |
| WO | 2022068231 | A1 | 4/2022 |
| WO | 2022112115 | A1 | 6/2022 |

OTHER PUBLICATIONS

Korean Patent Office, Office Action in Korean Patent Application No. 10-2023-0098562 (Jul. 21, 2025).

Japanese Patent Office, Decision to Grant a Patent in Japanese Patent Application No. 2023-123265 (Jul. 8, 2025).

Japanese Patent Office, Notice of Reasons for Refusal in Japanese Patent Application No. 2023-123265 (Sep. 10, 2024).

European Patent Office, Search Report in European Patent Application No. 23188292.9 (Jan. 30, 2024).

Chinese Patent Office, Office Action in Chinese Patent Application No. 202210946055.6 (Nov. 6, 2025).

Japanese Patent Office, Notice of Reasons for Refusal in Japanese Patent Application No. 2023-123265 (Feb. 18, 2025).

Korean Patent Office, Written Decision on Registration in Korean Patent Application No. 10-2023-0098562 (May 6, 2026).

European Patent Office, Office Action in European Patent Application No. 23188292.9 (Mar. 25, 2026).

* cited by examiner

AEROSOL-GENERATING DEVICE AND HEATING ASSEMBLY THEREOF

CROSS-REFERENCE TO PRIOR APPLICATION

Priority is claimed to Chinese Patent Application No. 202210946055.6, filed on Aug. 8, 2022, the entire disclosure of which is hereby incorporated by reference herein.

FIELD

The present invention relates to the field of vaporization, and in particular, relates to an aerosol-generating device and a heating assembly thereof.

BACKGROUND

A heat-not-burn aerosol-generating device is an electronic device that heats an aerosol-forming medium without the burning aerosol-forming medium. A core component of the heat-not-burn aerosol-generating device is a heating body. The heating body heats the aerosol-forming medium to a temperature at which aerosols can be produced without burning the aerosol-forming medium. In this way, the aerosol-forming medium can produce aerosols required by the user without burning.

An existing heating body is formed by a film tape wounding on and covering a heating rod. The film tape is provided with a heating pattern, a conductive pattern, or the like. The diameter tolerance of the heating rod covered by a film tape becomes larger. To improve the process yield and operability, a flange hole of a flange matched with the heating body needs to be larger. As a result, the yield of the heating body in terms of perpendicularity is affected. For example, the diameter tolerance of the heating rod is ±0.03 mm, and the diameter tolerance of the heating rod covered by the film tape is ±0.07 mm. As a result, the inner diameter of the flange hole needs to be increased. Therefore, a gap of at most 0.14 mm is left. Consequently, the yield of products in terms of perpendicularity is affected, and the yield can reach 85% at most in actual production.

SUMMARY

In an embodiment, the present invention provides a heating assembly, applicable to an aerosol-generating device, comprising: a heating rod; a covering film covering part of the heating rod; and a fixing base fitted on the heating rod, a fitting hole being formed on the fixing base, wherein the heating rod comprises a functional part with the covering film and a fitting part without the covering film, and wherein the fitting part is accommodated in the fitting hole.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
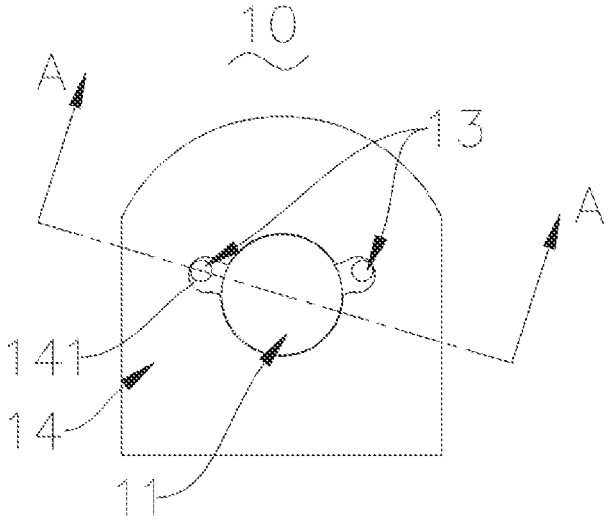
FIG. 1 is a top view of a heating assembly according to a first embodiment of the present invention.

In an embodiment, the present invention provides an improved heating assembly and an aerosol-generating device having same to resolve the defects above of the related technology.

In an embodiment, the present invention provides a heating assembly applicable to an aerosol-generating device. The heating assembly includes a heating rod, a covering film covering part of the heating rod, and a fixing base fitted on the heating rod. A fitting hole is formed on the fixing base. The heating rod includes a functional part with the covering film and a fitting part without the covering film. The fitting part is accommodated in the fitting hole.

In some embodiments, the heating rod is cylindrical, and the functional part and the fitting part are arranged in the axial direction of the heating rod.

In some embodiments, the functional part is completely located outside the fixing base, an end surface of the end of the functional part connected to the fitting part abuts against an end surface of the fixing base, or a gap exists between an end surface of the end of the functional part connected to the fitting part and the fixing base.

In some embodiments, a mounting hole communicated with the fitting hole is also formed on the fixing base, and the functional part is partially accommodated in the mounting hole.

In some embodiments, the cross-sectional dimension of the mounting hole is larger than that of the fitting hole, to form a step surface between the mounting hole and the fitting hole, and an end surface of the end of the functional part connected to the fitting part abuts against the step surface.

In some embodiments, the heating rod further comprises a tip portion, and the tip portion and the fitting part are respectively located at two ends of the functional part.

In some embodiments, the covering film includes a base film and a heating film provided on the base film.

In some embodiments, the heating film is provided on the inner side of the base film.

In some embodiments, the covering film further comprises two conductive films that are provided on the base film and connected to the heating film, and the heating assembly further comprises two electrode leads respectively connected to the two conductive films.

In some embodiments, two conducting holes are formed in the base film, and the conductive films each comprise an external connection part that is provided on the outer side of the base film and connected to the electrode lead and a conducting part that is provided in the conducting hole and connected to the heating film.

In some embodiments, the heating rod is made of an insulating material, and the heating film is attached to the heating rod.

In some embodiments, the heating rod is made of a conductive material, and the covering film further comprises an insulating film provided between the heating film and the heating rod.

In some embodiments, a gap is formed between the heating film and the fixing base.

In some embodiments, the covering film is formed by sintering a flexible film tape wound on the heating rod.

In some embodiments, the flexible film tape is manufactured by a tape casting process.

The present invention also provides an aerosol-generating device. The aerosol-generating device includes the heating assembly of any one of the above.

Implementation of the present invention at least has the following beneficial effects: Because the fitting part of the heating rod is not covered by the covering film, a high machining precision is achieved. In this way, the fit gap between the fitting part and the fitting hole is narrowed, thereby improving the yield of products in terms of perpendicularity.

To bring a clearer understanding of the technical features, objectives, and effects of the present invention, specific embodiments of the present invention are described with reference to the accompanying drawings. In the following description, specific details are described for thorough understanding of the present invention. However, the present invention can be implemented in many other manners different from those described herein. A person skilled in the art may make similar improvements without departing from the content of the present invention. Therefore, the present invention is not limited to the specific embodiments disclosed below.

In the description of the present invention, it should be understood that, orientation or position relationships indicated by terms such as "longitudinal", "axial", "upper", "lower", "top", "bottom", "inner", and "outer" are orientation or position relationships shown based on the accompanying drawings or orientation or position relationships that the product of the present invention is usually placed in use, and are merely used for describing the present invention and simplifying the description, rather than indicating or implying that the mentioned apparatus or element should have a particular orientation or be constructed and operated in a particular orientation. Therefore, these terms cannot be construed as a limitation to the present invention.

In addition, terms "first" and "second" are used merely for the purpose of description, and cannot be construed as indicating or implying relative importance or implying a quantity of indicated technical features. Therefore, a feature restricted by "first" or "second" may explicitly indicate or implicitly include at least one such feature. In the descriptions of the present invention, unless explicitly specified, "multiple" means at least two, for example, two or three.

In the present invention, it should be noted that unless otherwise explicitly specified and limited, the terms "mount", "connect", "connection", and "fix" should be understood in a broad sense. For example, a connection may be a fixed connection, a detachable connection, or an integral connection; or the connection may be a mechanical connection or an electrical connection; or the connection may be a direct connection, an indirect connection through an intermediary, or internal communication between two elements or mutual action relationship between two elements, unless otherwise specified explicitly. Persons of ordinary skill in the art may understand the specific meanings of the foregoing terms in the present invention according to specific situations.

Figure 2:
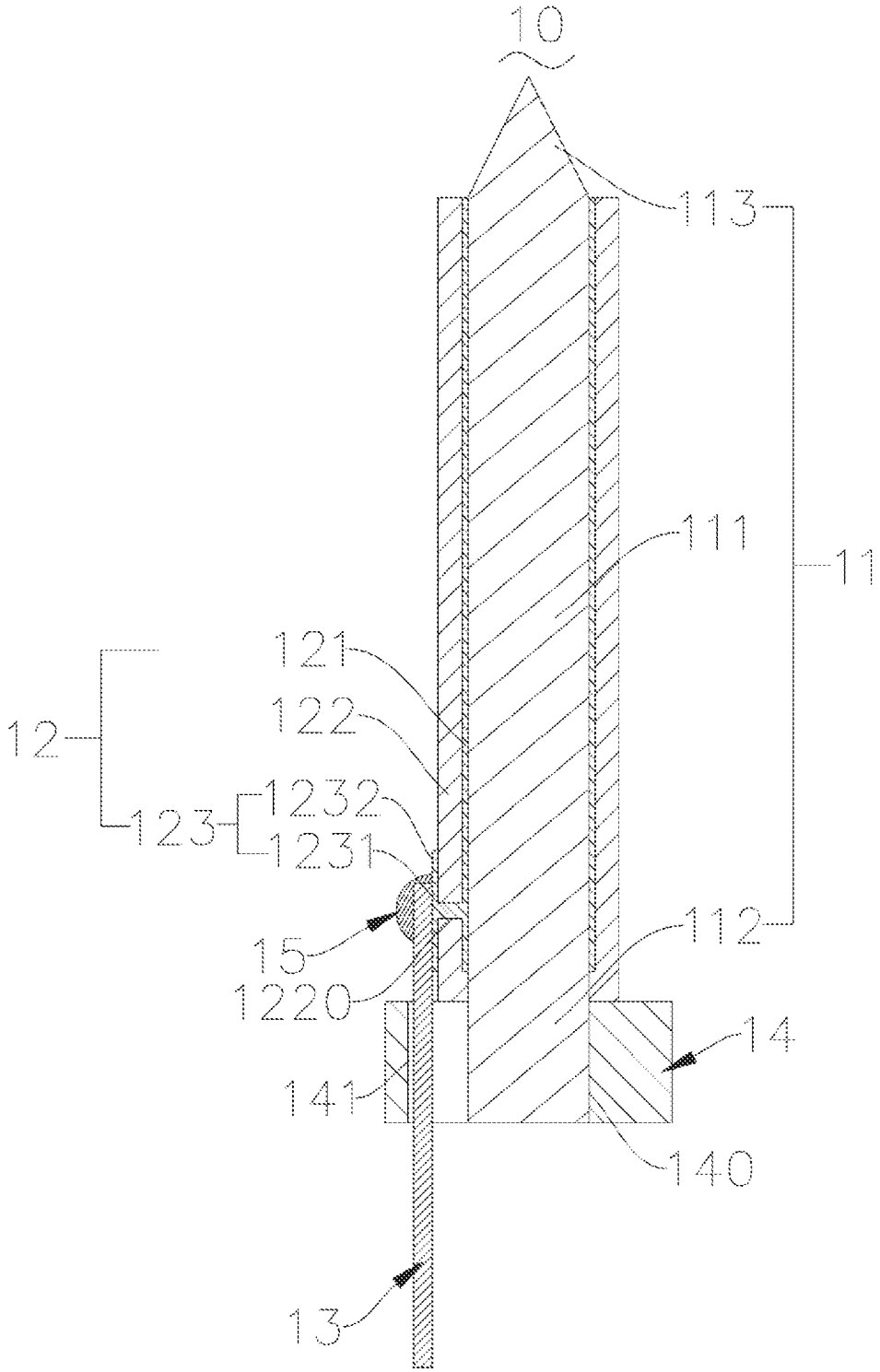
FIG. 2 is a schematic diagram of an A-A longitudinal section structure of the heating assembly shown in FIG. 1.

FIG. 1 to FIG. 2 shows a heating assembly 10 in a first embodiment of the present invention. The heating assembly 10 includes a heating rod 11, a covering film 12 covering part of the heating rod 11, and a fixing base 14 fitted on the heating rod 11. The heating assembly 10 may be configured to insert into an aerosol-forming medium and heat the aerosol-forming medium by baking after being powered up.

The heating rod 11 is configured to provide rigid support for the covering film 12. The heating rod may be cylindrical or sheet-shaped, or may be a solid structure or a hollow structure, and is not specifically limited. The material of the heating rod 11 may be a conductive material, or may be a non-conductive insulating material. The thermal conductivity is generally considered during selection of the material and the structure of the heating rod 11. Generally, the heating assembly 10 including the heating rod 11 made of a high-thermal-conductivity material has high energy consumption. The heating assembly 10 including the heating rod 11 of the solid column structure has high energy consumption.

In this embodiment, the heating rod 11 is a solid cylinder and is made of an insulating material, such as ceramics or high temperature resistant plastics. The heating rod 11 includes a functional part 111 with the covering film 12 and a fitting part 112 without the covering film 12. The functional part 111 and the fitting part 112 are arranged in the axial direction of the heating rod 11. Further, the heating rod 11 may also include a tip portion 113 located at one end of the heating rod 11. The tip portion 113 may be conical or frustum-shaped. The heating assembly 10 is inserted into the aerosol-forming medium through the tip portion 113. In this embodiment, the tip portion 113, the functional part 111, and the fitting part 112 are arranged sequentially from top to bottom in the axial direction of the heating rod 11.

The covering film 12 may cover the functional part 111 of the heating rod 11 by winding. The covering film may include a base film 122 and a heating film 121 provided on the base film 122. The heating film 121 is configured to generate heat after being powered up to heat the aerosol-forming medium. The base film 122 is configured to provide a forming base for the heating film 121. In some embodiment, the base film 122 may be a flexible thin-film tape formed by a tape casting process. The heating film 121 may be formed on the base film 122 by screen printing, electroplating or physical vapor deposition, or the like. The material of the base film 122 may be one or any combination of microcrystalline glass, glass-ceramic (such as calcium borosilicate glass-silicon oxide), low-temperature ceramic (such as tin-barium borate ceramic and zirconium-barium borate ceramics), provided that the material can be sintered below 1000° C. In an embodiment, the material of the base film 122 is glass-ceramic material. The heating film 121 may be made of a high-resistivity material, to produce more heat after being powered up.

Further, in this embodiment, the heating film 121 is provided on the inner side of the base film 122 and is closely attached to the heating rod 11. Because the heating film 121 is covered by the base film 122, the heating film 121 is not exposed, and the heating film 121 has oxidation and corrosion risks, thereby increasing the service life of the heating assembly 10. In addition, the base film 122 made of materials such as glass and/or ceramic makes the outer surface of the base film 122 also have high smoothness. The smooth surface is easy to clean, can prevent bad smell caused by residue accumulated on the outer surface of the base film 122 after long-term use, and bring good use experience to consumers. In another embodiment, the surface smoothness may alternatively be improved by coating a glaze layer on the outer side of the base film 122.

Further, the heating assembly 10 further includes two conductive films 123 respectively connected to two poles of the heating film 121 and two electrode leads 13 respectively connected to the two conductive films 123. The heating assembly 10 is connected to an external power supply through the two electrode leads 13. The conductive films 123 and the electrode leads 13 can be made of a low-resistivity material, which produces no heat or little heat after being powered up.

In this embodiment, the two conductive films 123 are provided on the lower end of the base film 122, and may be formed on the base film 122 by screen printing, electroplating or physical vapor deposition, or the like. Two conducting holes 1220 are formed in the base film 122. The conductive films 123 each include a conducting part 1231 that is provided in the conducting hole 1220 and an external connection part 1232 that is provided on the outer side of the base film 122. The external connection part 1232 is connected to the heating film 121 through the conducting part 1231. The electrode lead 13 may be connected to the external connection part 1232 by coating conductive paste or welding or the like. The outer side of the external connection part 1232 may also be provided with a conductive disc 15. The electrode lead 13 is connected to the external connection part 1232 through the conductive disc 15. In one embodiment, the conductive disc 15 is a pad. The electrode lead 13 may be connected to the conductive disc 15 by high-temperature brazing using a silver-copper flux. In another embodiment, the conductive disc 15 is formed by sintering the conductive paste coated on the external connection part 1232.

The fixing base 14 is at least partially disposed on the fitting part 112 of the heating rod 11, and may be made of a high-temperature resistant material such as ceramic or PEEK (polyetheretherketone). The fixing base 14 is provided with a fitting hole 140 configured to accommodate the fitting part 112 and two wire passages 141 respectively configured to allow the two electrode leads 13 to pass through. The fitting part 112 is matched with the fitting hole 140. The cross-section shape and dimension of the fitting part 112 are matched with the cross-section shape and dimension of the fitting hole 140, to achieve installation and fixation of the heating rod 11. The fitting part 112 without the covering film 12 has a higher precision than the functional part 111 (that is, the fitting part 112 has a precision as high as the machining precision of the heating rod 11). In this way, the fitting part 112 and the fitting hole 140 can achieve a better clearance fit, thereby improving the yield of products in terms of perpendicularity. For example, the hole precision of the fitting hole 140 is ±0.03 mm, the rod precision of the fitting part 112 is ±0.03 mm, and the maximum gap between the fitting part 112 and the fitting hole 140 is 0.06 mm. Compared with the existing structure, the maximum gap is greatly reduced, thereby improving the yield of products in terms of perpendicularity. In actual production, the yield of each batch of the heating assembly 10 in terms of perpendicularity can reach 93% to 100%. The outer wall of the fitting part 112 and the hole wall of the fitting hole 140 can be bonded and fixed by glass glaze or a ceramic material.

In this embodiment, the fitting hole 140 extends longitudinally from the lower end surface of the fixing base 14 to the upper end surface of the fixing base 14. The wire passage 141 is formed by depression of the hole wall of the fitting hole 140. The lower end surface of the covering film 12 abuts against the upper end surface of the fixing base 14. In this way, the covering film 12 can achieve a positional limiting function during mounting the heating rod 11 and the fixing base 14, without adding a positional limiting fixture, thereby simplifying the size control process. There is a certain distance between the lower end surface of the heating film 121 and the upper end surface of the fixing base 14, to facilitate heat insulation and reduce heat transfer from the heating film 121 to the fixing base 14. In another embodiment, there is also a certain spacing between the lower end surface of the covering film 12 and the upper end surface of the fixing base 14. This can facilitate actual production. In some other embodiments, the lower end of the covering film 12 may alternatively be partially inserted in the fixing base 14.

Figure 3:
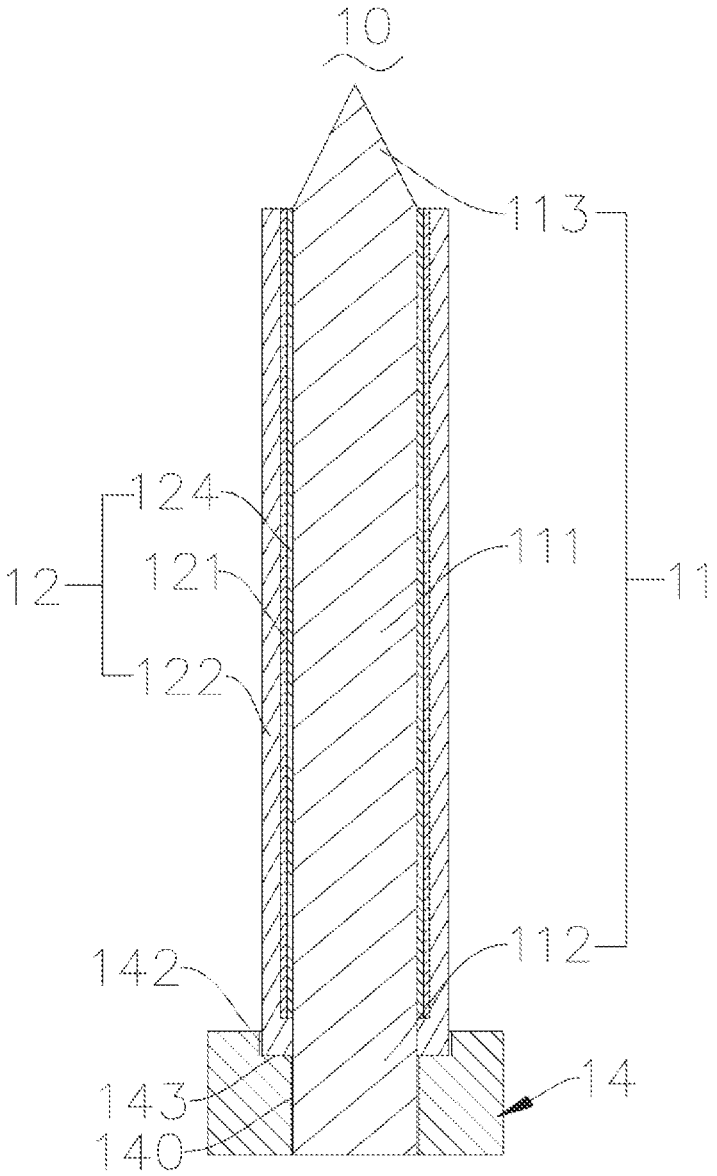
FIG. 3 is a schematic diagram of a longitudinal section structure of a heating assembly according to a second embodiment of the present invention.

FIG. 3 shows a heating assembly 10 according to a second embodiment of the present invention, which is different from the first embodiment mainly in that a heating rod 11 in this embodiment is made of an electrically conductive material such as metal, and the lower end of a covering film 12 is inserted in a fixing base 14 in this embodiment.

Because the heating rod 11 is conductive, the covering film 12 in this embodiment also includes an insulating film 124. The insulating film 124 is arranged between the heating rod 11 and a heating film 121 to insulate the heating rod 11 from the heating film 121.

A mounting hole 142 configured to accommodate the lower end of the covering film 12 is also formed on the fixing base 14. The mounting hole 142 is extended downward from the upper end surface of the fixing base 14 along the longitudinal direction. The fitting hole 140 is extended upward from the lower end surface of the fixing baser 14 along the longitudinal direction to be communicated with the mounting hole 142, and the cross-sectional dimension of the mounting hole 142 is larger than that of the fitting hole 140. The yield of the heating assembly 10 in terms of perpendicularity is achieved by the fit between the fitting hole 140 and the fitting part 112. In addition, the lower end surface of the covering film 12 can abut against a step surface 143 between the mounting hole 142 and the fitting hole 140. In this way, the covering film 12 can also achieve a positional limiting function during mounting, thereby simplifying the size control process.

Figure 4:
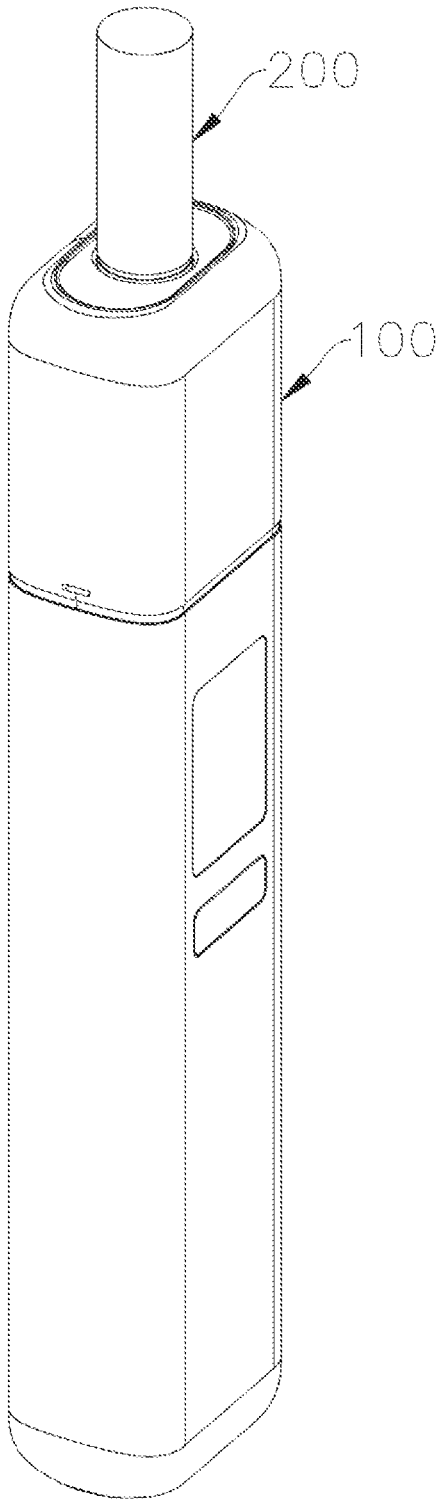
FIG. 4 is a schematic diagram of a three-dimensional structure of an aerosol-generating device accommodating an aerosol-forming medium according to some embodiments of the present invention.
Figure 5:
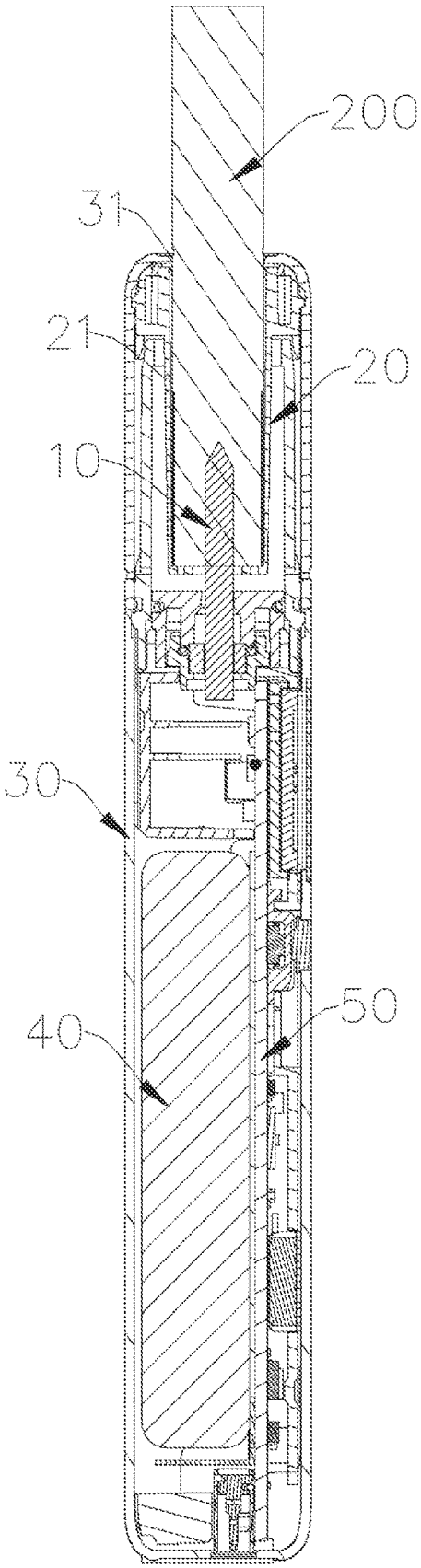
FIG. 5 is a schematic diagram of a longitudinal section structure of the aerosol-generating device accommodating an aerosol-forming medium shown in FIG. 4.

FIG. 4 to FIG. 5 shows an aerosol-generating device 100 according to some embodiments of the present invention. The aerosol-generating device 100 may be configured to bake and heat an aerosol-generating medium 200 inserted therein at a low temperature to release an aerosol extract in the aerosol-generating medium 200 without burning. The aerosol-forming medium 200 may be cylindrical. The aerosol-generating device 100 may be roughly square cylindrical. The aerosol-forming medium 200 may be detachably inserted into the aerosol-generating device 100 to facilitate removal of the aerosol-forming medium completely consumed by heating and installation of a new aerosol-generating medium 200. It may be understood that in other embodiments, the aerosol-generating device 100 is not limited to the shape of a square cylinder, and may alternatively be in a shape of a round cylinder, an elliptical cylinder, or other shapes. The aerosol-forming medium 200 is also not limited to being cylindrical, and may alternatively be in a shape of an elliptical cylinder or other shapes.

The aerosol-generating device 100 include a shell 30 as well as a heating assembly 10, an accommodating tube 20, a battery 40, and a mainboard 50 that are accommodated in the shell 30. The heating assembly 10 may be a heating assembly according to any one of the foregoing embodiments. The inner wall of the accommodating tube 20 defines an accommodating space 21 configured to accommodate the aerosol-forming medium 200. The top wall of the shell 30 has an insertion hole 31 allowing for the insertion of the aerosol-forming medium 200. The aerosol-forming medium 200 may be inserted into the accommodating space 21 through the insertion hole 31. The upper end of the heating assembly 10 may be extended into the accommodating space 21 and insert into the aerosol-forming medium 200 to bake and heat the aerosol-forming medium 200 after being powered up. The mainboard 50 is electrically connected to the battery 40 and the heating assembly 10 separately. A relevant control circuit is provided on the mainboard 50 and can control the connection between the battery 40 and the heating assembly 10 through a switch provided on the shell 30.

It may be understood that the above technical features can be used in any combination without limitation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A heating assembly, applicable to an aerosol-generating device, comprising:

a heating rod;

a covering film covering part of the heating rod; and a fixing base fitted on the heating rod, a fitting hole being formed on the fixing base, wherein the heating rod comprises a functional part with the covering film and a fitting part without the covering film, wherein the fitting part is accommodated in the fitting hole, wherein a mounting hole communicating with the fitting hole is formed on the fixing base, and wherein the functional part is partially accommodated in the mounting hole.

2. The heating assembly of claim 1, wherein the heating rod is cylindrical, and the functional part and the fitting part are arranged in an axial direction of the heating rod.

3. The heating assembly of claim 1, wherein the functional part is located completely outside the fixing base, wherein an end surface of an end of the functional part connected to the fitting part abuts against an end surface of the fixing base, or a gap exists between an end surface of the end of the functional part connected to the fitting part and the fixing base.

4. The heating assembly of claim 1, wherein a cross-sectional dimension of the mounting hole is larger than a cross-sectional dimension of the fitting hole so as to form a step surface between the mounting hole and the fitting hole, and wherein an end surface of an end of the functional part connected to the fitting part abuts against the step surface.

5. The heating assembly of claim 1, wherein the heating rod comprises a tip portion, and wherein the tip portion and the fitting part are respectively located at two ends of the functional part.

6. The heating assembly of claim 1, wherein the covering film comprises a base film and a heating film provided on the base film.

7. The heating assembly of claim 6, wherein the heating film is provided on an inner side of the base film.

8. The heating assembly of claim 7, wherein the covering film comprises two conductive films that are provided on the base film and connected to the heating film, and wherein the heating assembly comprises two electrode leads respectively connected to the two conductive films.

9. The heating assembly of claim 8, wherein two conducting holes are formed in the base film, and wherein the conductive films each comprise an external connection part that is provided on an outer side of the base film and connected to the electrode lead, and a conducting part that is provided in the conducting hole and connected to the heating film.

10. The heating assembly of claim 7, wherein the heating rod comprises an insulating material, and wherein the heating film is attached to the heating rod.

11. The heating assembly of claim 7, wherein the heating rod comprises a conductive material, and wherein the covering film comprises an insulating film provided between the heating film and the heating rod.

12. The heating assembly of claim 6, wherein a gap is formed between the heating film and the fixing base.

13. The heating assembly of claim 6, wherein the covering film is formed by sintering a flexible film tape wound on the heating rod.

14. The heating assembly of claim 13, wherein the flexible film tape is manufactured by a tape casting process.

15. An aerosol-generating device, comprising:

the heating assembly of claim 1.

16. A heating assembly, applicable to an aerosol-generating device, comprising:

a heating rod;

a covering film covering part of the heating rod; and a fixing base fitted on the heating rod, a fitting hole being formed on the fixing base, wherein the heating rod comprises a functional part with the covering film and a fitting part without the covering film, wherein the fitting part is accommodated in the fitting hole, wherein the covering film comprises a base film and a heating film provided on the base film, and wherein a gap is formed between the heating film and the fixing base.

17. The heating assembly of claim 16, wherein the heating rod is cylindrical, and the functional part and the fitting part are arranged in an axial direction of the heating rod.

18. The heating assembly of claim 16, wherein the functional part is located completely outside the fixing base, wherein an end surface of an end of the functional part connected to the fitting part abuts against an end surface of the fixing base, or a gap exists between an end surface of the end of the functional part connected to the fitting part and the fixing base.

19. The heating assembly of claim 16, wherein the heating rod comprises a tip portion, and wherein the tip portion and the fitting part are respectively located at two ends of the functional part.

20. The heating assembly of claim 16, wherein the heating film is provided on an inner side of the base film.

* * * * *